United States Patent [19]

Taheri

[11] Patent Number: 4,637,074

[45] Date of Patent: Jan. 20, 1987

[54] PROTECTIVE GARMENT

[76] Inventor: Syde A. Taheri, 268 Dan Troy, Williamsville, N.Y. 14221

[21] Appl. No.: 840,053

[22] Filed: Mar. 17, 1986

[51] Int. Cl.[4] ..... A41D 13/00

[52] U.S. Cl. ..... 2/2; 2/DIG. 3

[58] Field of Search ..... 2/2, DIG. 3; 441/88, 441/90, 102

[56] References Cited

U.S. PATENT DOCUMENTS

| | | | |
|---|---|---|---|
| 3,243,822 | 4/1966 | Lipkin | 2/2 |
| 3,827,716 | 8/1974 | Vaughn et al. | 2/DIG. 3 |
| 3,895,396 | 7/1975 | Amarantos | 2/2 |
| 3,921,944 | 11/1975 | Morrison | 2/2 X |
| 4,039,039 | 8/1977 | Gottfried | 2/DIG. 3 |
| 4,059,852 | 11/1977 | Crane | 2/2 |
| 4,089,065 | 5/1978 | McGee | 2/DIG. 3 |

FOREIGN PATENT DOCUMENTS

| | | | |
|---|---|---|---|
| 2499373 | 8/1982 | France | 2/DIG. 2 |

*Primary Examiner*—Louis K. Rimrodt

*Attorney, Agent, or Firm*—Christel, Bean & Linihan

[57] ABSTRACT

A protective garment having a vest portion for substantially covering the torso of a wearer utilizes inflatable envelopes adapted to inflate upon the occurrence of a predetermined event, such as a collision of an automobile in which the wearer is riding, for providing protective cushioning about selected regions of the wearer's body.

24 Claims, 13 Drawing Figures

Fig. 4.
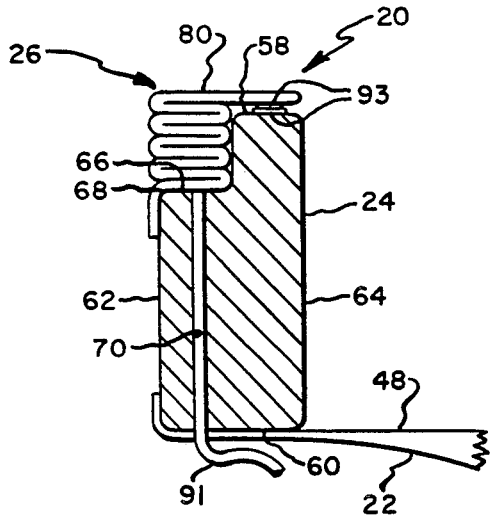
Fig. 5.
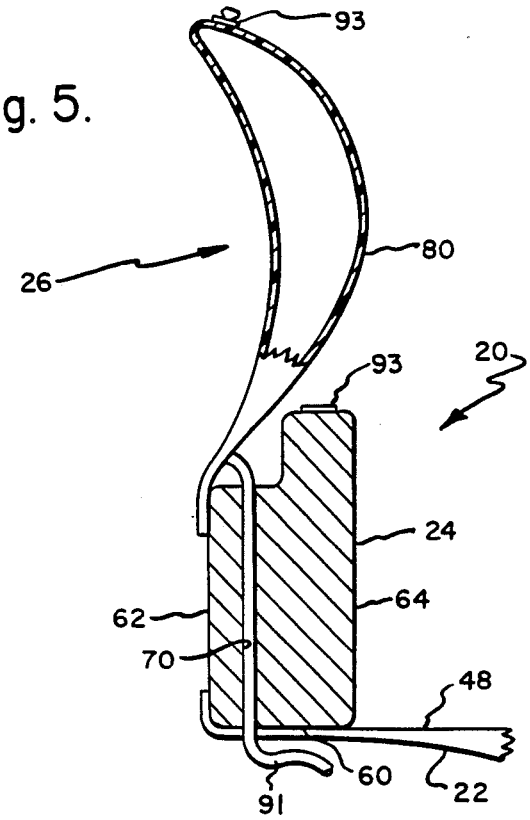
Fig. 6.
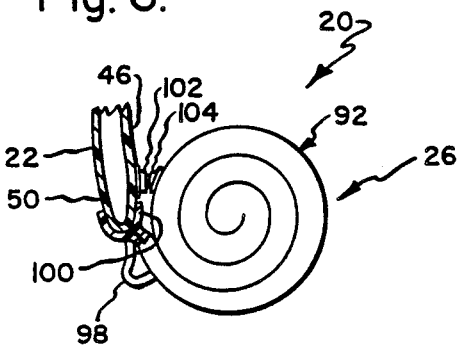
Fig. 7.
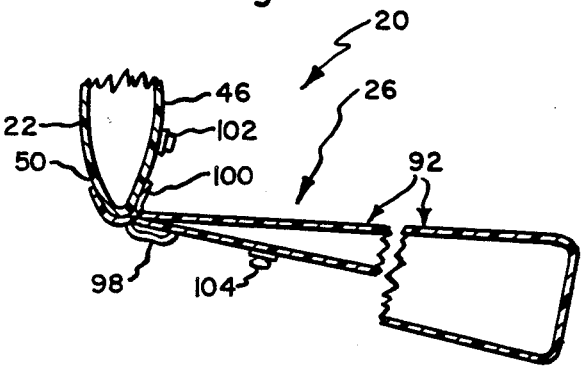
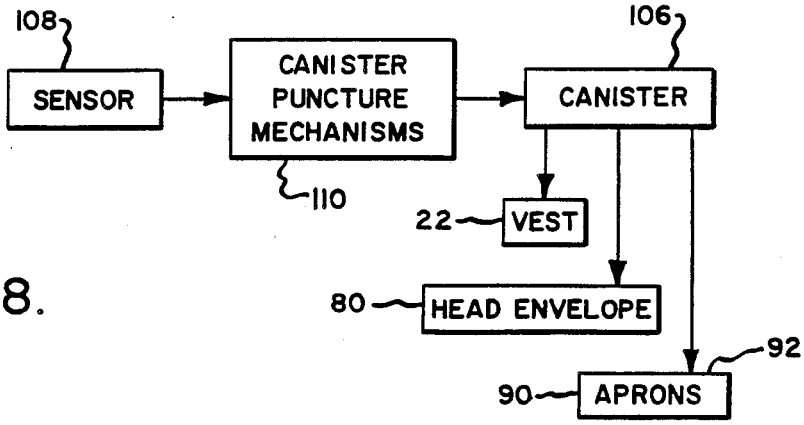
Fig. 8.

Fig. 9.
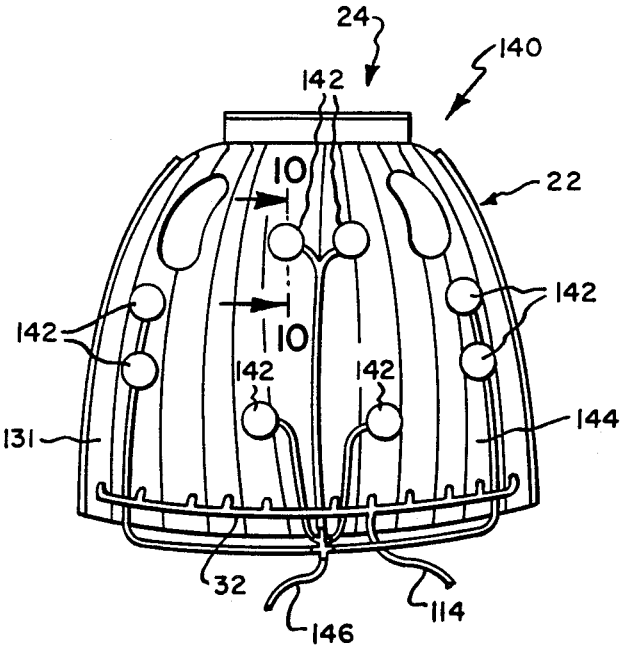
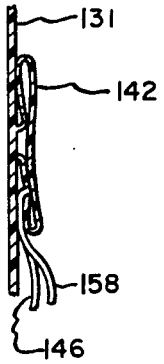
Fig. 10.
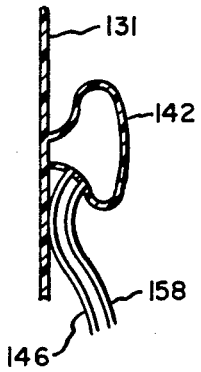
Fig. 11.
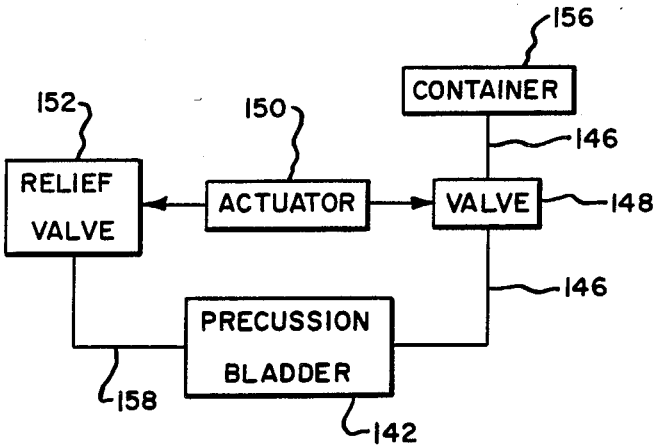
Fig. 12.
Fig. 13.
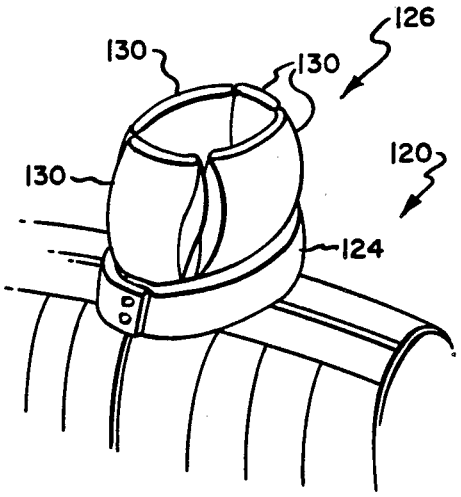

PROTECTIVE GARMENT

BACKGROUND OF THE INVENTION

This invention relates generally to garments for protecting a wearer from a collision-related injury and more particularly is concerned with a protective garment having portions which inflate upon the occurrence of a predetermined event.

The type of protective garment with which this invention is to be compared is adapted to be worn by a wearer and which has portions which are adapted to inflate upon the occurrence of a predetermined event, such as a collision of an automobile in which the wearer is riding. The inflatable portions, when inflated, are intended to provide a protective cushion between the wearer's body and an object which may otherwise strike or be struck by the wearer's body. Such a garment, in the form of a safety vest, is shown and described in U.S. Pat. No. 3,827,716.

It is an object of the present invention to provide a new and improved protective garment of the aforedescribed type.

Another object of the present invention is to provide such a garment providing effective protection for selected regions or parts, such as the thoracic cage, abdominal viscera, knee, pelvis, thigh and cervical spine, of the wearer's body.

Still another object of the present invention is to provide such a garment which provides substantial support for the wearer's head and neck during a collision.

Yet still another object of the present invention is to provide such a garment which is comfortable to a wearer and permits a great deal of wearer mobility when worn.

A further object of the present invention is to provide such a garment which effectively distributes the impact of a collision over a relatively large area of the garment.

A still further object of the present invention is to provide such a garment which can be used to selectively heat or cool the wearer.

A yet still further object of the present invention is to provide such a garment having means for precussing selected regions of the wearer's torso.

One other object of the present invention is to provide such a garment which is economical to manufacture and effective in operation.

SUMMARY OF THE INVENTION

This invention resides in a new and improved protective garment having inflatable sections for protecting a wearer from a collision-related injury.

The protective garment includes means defining a vest having a front, a back, two sides, a neck portion and a waist portion for substantially covering the torso of a wearer, at least one inflatable envelope attached to the vest-defining means, and means for inflating the envelope upon the occurrence of a predetermined event. In one embodiment, the garment includes a collar member attached to the vest neck portion and of such size so as to encircle and substantially cover the wearer's neck, and a first inflatable envelope is connected to and maintained in a relatively compact condition adjacent the collar member when the first envelope is uninflated. When operatively inflated, the first envelope provides a cushioned protective sleeve which substantially encircles the wearer's head. Collectively, the collar member and inflated envelope substantially reduce the likelihood of an injury to the neck and head it the wearer's body were to suddenly strike or be struck by an object.

In another embodiment, the garment includes a second and third inflatable envelope associated with the inflating means and connected to the vest waist portion. The second and third envelopes, when uninflated, are maintained in a relatively compact condition along a corresponding side of the vest and, when operatively inflated, collectively provide a cushioned protective apron covering at least the side and front of the wearer's thighs.

BRIEF DESCRIPTION OF THE DRAWING FIGURES

FIG. 4 is a cross sectional view of the garment taken about on lines 4-4 of FIG. 1.

FIG. 5 is a cross-sectional view taken about on lines 5—5 of FIG. 2.

FIG. 6 is a cross-sectional view taken about on lines 6—6 of FIG. 1.

FIG. 7 is a cross-sectional view taken about on lines 7—7 of FIG. 2.

FIG. 8 is a schematic representation illustrating in block diagram form the operation of the FIG. 1 garment upon the occurrence of a predetermined event.

FIG. 9 is a perspective view of an additional embodiment of a garment in accordance with the present invention when opened from the front so as to expose the inside thereof.

FIG. 10 is a cross-sectional view taken about on line 10—10 of FIG. 9 illustrating the condition of the precussion bladder when uninflated.

FIG. 11 is a cross-sectional view similar to that of FIG. 10 illustrating the condition of the precussion bladder when inflated.

FIG. 12 is a schematic representation illustrating in block diagram form the precussing operation of the FIG. 9 garment.

FIG. 13 is a fragmentary perspective view of an alternative embodiment of a garment in accordance with the present invention.

DETAILED DESCRIPTION OF THE ILLUSTRATED EMBODIMENTS

Figure 2:
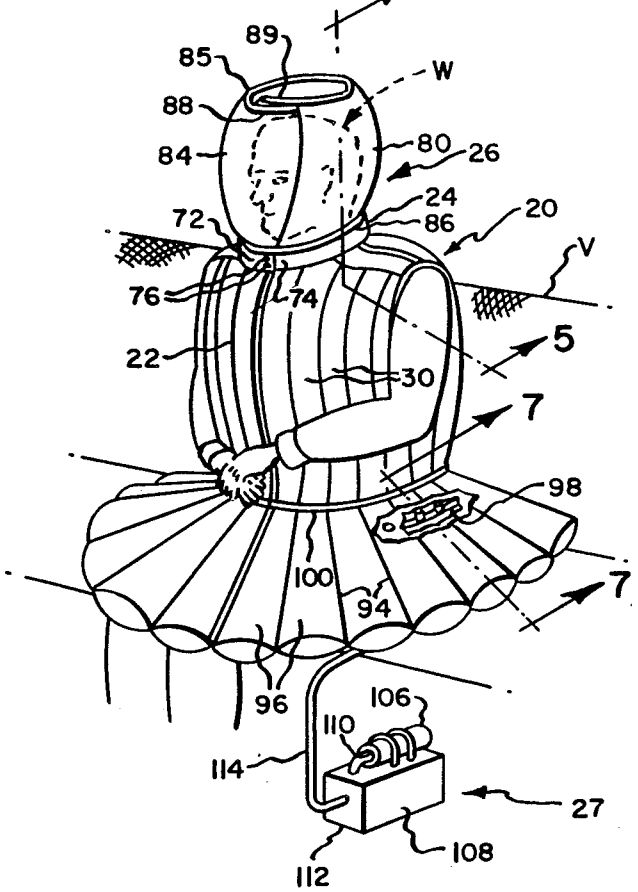
FIG. 2 is a perspective view similar to that of FIG. 1 illustrating the FIG. 1 garment when its inflatable sections are in an inflated condition.
Figure 1:
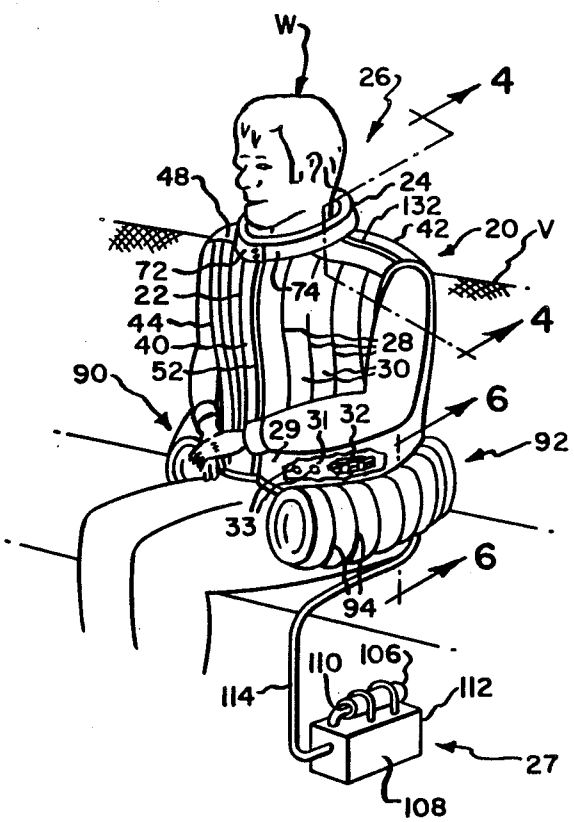
FIG. 1 is a perspective view, shown partially cut away, of an embodiment of a protective garment in accordance with the present invention shown worn by a vehicle occupant and shown with its inflatable sections in an uninflated condition.

Turning now to the drawings in greater detail and considering first FIGS. 1 and 2, there is shown a protective garment, generally indicated 20, in accordance with the present invention and shown worn by a wearer W seated within a vehicle seat V. The garment 20 includes means defining an inflatable vest portion 22 for substantially covering the torso of the wearer W, a collar member 24 and means, generally indicated 26, defining inflatable envelopes hereinafter described connected to the vest portion 22. Associated with the garment 20 are means, generally indicated 27, for inflating the vest portion 22 and the envelope-defining means 26 upon the occurrence of a predetermined event.

The vest portion 22 of the garment 20 includes two layers 29, 31 of durable air-impermeable fabric such as a flexible plastic material, which are bonded or heat-sealed together along bond lines 28,28 so as to define a plurality of inflatable bladder compartments 30,30 disposed about the wearer's torso. Each compartment 30 or 30 defines an opening 33 to which a tube or conduit 32 is sealingly attached so that each compartment 30 is in flow communication with its adjacent compartment 30 or 30 by means of the tube 32. It follows that by forcing air or another compressible gas through the tube 32, each vest compartment 30 inflates to an expanded condition as shown in FIG. 2.

The vest portion 22 includes a front 40, a back 42, two opposite sides 44,46, a neck portion 48 and a waist portion 50. Whether the compartments 30,30 are in an uninflated condition as shown in FIG. 1 or in an inflated condition as shown in FIG. 2, the bonded vest layers 29, 31 fit relatively loosely about the wearer's torso so as to provide the wearer W with a large degree of limb mobility. For purposes of fastening the vest portion 22 about or removing the vest portion 22 from the wearer, the front 40 of the vest portion 22 includes a zipper 52.

Figure 3:
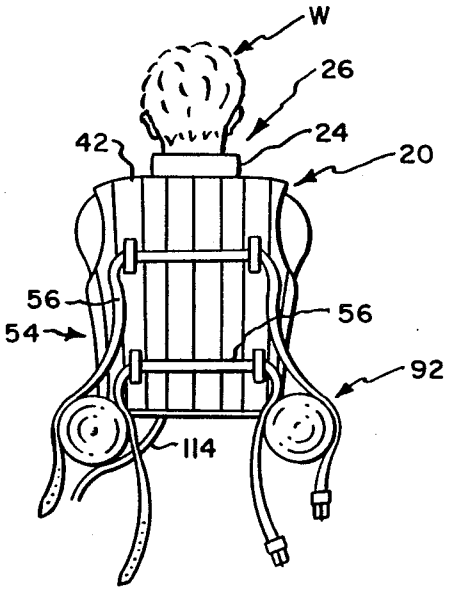
FIG. 3 is an elevation view of the back of the FIG. 1 garment.

With reference to FIG. 3, the garment 20 includes means, indicated 54, for attaching the garment 20 to a chair or the like. In the garment 20, the attaching means 54 includes a pair of straps 56,56 fixedly connected across the back 42 of the vest portion 22 and each strap has two ends adapted to be fastened to one another. The straps 56,56 can therefore be fastened to the back of a seat in which the wearer W is seated and thus permit the wearer W to be strapped to the seat. The capacity provided by the straps 56,56 to attach the garment to a chair can be readily appreciated if the seat is a wheelchair and it is desired to prevent the wearer W from accidently falling out of the wheelchair.

The collar member 24 is in the form of an elongated body of material attached to the neck portion 48 and extending upwardly therefrom as shown in FIGS. 1 and 2 and so as to encircle the wearer's neck. For purposes of protecting the neck, the member 24 is preferably constructed of a relatively soft flexible material such as a foam rubber material. As best shown in FIG. 4, the collar member 24 is block-like in cross section having an upper surface 58, a lower surface 60, an inside surface 62 adapted to generally face the wearer W when the garment 20 is worn, an outside surface 64 opposite the inside surface 62, and a notch 66. Furthermore and as shown in FIG. 4, the notch 66 defines an upwardly-facing shelf 68, and the member 25 further defines a vertical bore 70 extending from the shelf 68 to the lower surface 60 for a reason which will be apparent hereinafter. The vest neck portion 48 is sewn or otherwise attached to the inside surface 62, and for the purpose of fastening the collar member 24 about or removing the member 24 from the neck of the wearer W, the member 24 includes overlapping portions 72,74 (FIGS. 1 and 2) releasably joined together with press-type fasteners or snaps 76,76.

Still further, the collar member 24 is of such size as to substantially cover the wearer's neck when the garment 20 is operatively worn. More specifically, the height of the collar member 24 as measured between the upper and lower surfaces 58 and 60 is about equal to the height of the wearer's neck so that when placed thereabout, the collar member 24 spans the vertical distance between the wearer's shoulders and chin. Because the collar member 24 is self-supporting in a upstanding condition about and covers the wearer's neck as aforesaid, the wearer's neck is substantially braced in alignment with the torso.

In accordance with the present invention and with reference to FIGS. 4 and 5, the envelope-defining means 26 includes a substantially enclosed distensible and inflatable envelope 80. The envelope 80 is constructed of a durable air-impermeable transparent material such as a transparent plastic, and has two concentrically-arranged layers bonded together to form, when inflated, a sleeve-like compartment 84. As shown in FIG. 2, the compartment 84 is generally bulbous in outer shape and defines top and bottom edges 85,86 respectively, and two side edge portions 88 and 89 which, as shown in the inflated condition of FIG. 2, overlap one another in front of the wearer's face. As shown in FIG. 4, the bottom edge 86 of the envelope compartment is suitably attached to the inside surface 62 of the collar member 24 and is of substantially the same length of the collar member 24 so that each of the side edge portions 88 or 89 corresponds with one of the end or overlapping portions 72 or 74 of the collar member 24. For purposes of inflating the envelope 80 in a manner hereinafter described, a tube 91 extends through the bore 70 in the collar member 24 and is suitably and sealingly connected to one layer of the envelope 80 about a hole defined therein.

When in an uninflated condition as shown in FIG. 4, the envelope is arranged and releasably maintained in a relatively compact condition adjacent the collar member 24. More specifically, the envelope 80 is collapsed and folded upon the collar member shelf 68. Press-type fastener members 93,93, such as hook and loop-type members manufactured under the trademark Velcro, are connected to the upper surface 58 of the collar member 24 and the envelope 80 adjacent the top edge 84 thereof for releasably securing the uppermost envelope edge to the collar member 24. When air or another compressed gas is forced through the tube 91 in a manner hereinafter described, the envelope 80 expands so that the top edge 84 is thrust upwardly an released from the collar member surface 58. In its fully expanded or inflated FIG. 2 condition, the envelope 80 forms a cushioned protective sleeve surrounding the wearer's head so that the wearer's face and sides and back of the head are covered.

In addition to the cushioning provided by the inflated envelope 80, the bulbous form of the inflated envelope 80 defines a head-supportive sleeve for structurally supporting and maintaining the head in a relatively rigid condition relative to the collar member 24 during an abrupt shifting of the wearer such as may occur during a collision of a vehicle in which the wearer is riding. If, for example, the wearer's head rebounds off of a steering wheel during an automobile accident, the portion of the envelope 80 positioned behind the wearer's head provides structural support to effectively protect the neck from a rebound injury.

Furthermore, the overlapping edge portions 88,89 of the inflated envelope 80 provde a double layer of cushioning positioned in front of the wearer's face. Still further, because the inflated envelope 80 is transparent, the wearer's vision is not hindered by the portion of the inflated envelope 80 positioned in front of the eyes.

With reference to FIGS. 1, 2, 6 and 7, the envelope-defining means 26 further includes a pair of substantially enclosed distensible and inflatable envelopes 90,92 attached to the vest portion 22 about the waist portion 50 thereof. Each envelope 90 or 92 is constructed of a durable air-impermeable material, such as a flexible plastic, and has two layers which when placed in a spread condition are somewhat trapezoidal in shape. The trapezoidal layers are joined along bond lines 94,94 to form a series of individual distensible compartments 96,96 as best shown in FIG. 7. Each compartment 96 defines an opening to which a tube 98 is connected and each compartment 96 is in flow communication with its adjacent compartment through the tube 98. One edge, indicated 100, of each envelope 90 and 92 is suitably attached to the vest waist portion 50 along a corresponding one of the sides 44,46 thereof.

When in an uninflated condition as shown in FIG. 6, each envelope 90 or 92 is arranged or releasably maintained in a relatively compact condition adjacent the vest waist portion 50. More specifically, and as exemplified by envelope 92 of FIG. 6, each envelope 90 or 92 is arranged in a rolled condition and releasably maintained adjacent the vest waist portion 50 with press-type fastener members 102,104 suitably connected to the vest sides 44,46 and envelopes 90,92. When air or another compressed gas is forced through the tube 98 in a manner hereinafter described, each envelope 90 or 92 expands so that the envelopes 90,92 are thrust radially outwardly of the wearer's torso and are released from the vest sides 44,46. When fully expanded or inflated to condition of FIG. 2 and 7, the envelopes 90,92 collectively provide a cushioned apron which substantially covers the front and sides of the wearer's thighs. During a collision of a vehicle in which the wearer W is riding, the apron is believed to effectively protect the knees, pelvis and thighs from an impact against the vehicle dashboard.

With reference to the FIGS. 1, 2 and 8, the means 27 for inflating the vest portion 22 and envelopes 80, 90 and 92 may take any of a number of forms known in the art. In the FIG. 1 embodiment, the inflating means 27 includes a canister 106 of compressed air or gas operatively connected by means of a tube 114 to the tubes 32, 91 and 98, sensing means 108 for determining the occurrence of a predetermined event, and canister-puncturing mechanisms 110 for releasing the canister gas into the tubes 32, 91 and 98 in response to a signal received by the sensing means 108.

For purposes of protecting the wearer W from a collision of a vehicle in which the wearer W is riding, the sensing means 108 can take the form of an accelerometer 112 shown mounted beneath the vehicle seat V in FIG. 1. In operation, the accelerometer 112 senses a vehicle collision characterized by a sudden or prescribed deceleration of the vehicle and actuates the puncturing mechanisms 110 for releasing the canister gas in response to the sensed collision.

In addition to the applications involving vehicle collisions, the principles of this invention can also be employed in applications in which the wearer W is stationary and falls over, as, for example, when the wearer W falls out of a chair. For such an application, the sensing means 108 can be in the form of a device, such as a mercury-type switch, for detecting a change in orientation of the wearer and actuating the canister puncturing mechanisms 110 in response to the sensed change.

With reference to FIGS. 9–11, there is shown an additional embodiment, generally indicated 140, of the garment of this invention in which a plurality of inflatable bladders 142,142 are disposed over the inner surface, indicated 131, of the garment 140. Components of the garment 140 which correspond to components of the garment 20 of FIGS. 1–7 are accordingly given the same reference numerals. The vest portion 22 of the garment 140 has an inner or inside layer 144, and each bladder 142 or 142 is integrally formed with inner layer 144 so as to provide an inflatable envelope attached thereto. Furthermore and as shown in FIG. 10 in an uninflated condition, each bladder 142 is adapted to lie relatively flat against the inside surface 131 of the garment vest portion 22. As shown in FIG. 11 and in an inflated condition, each bladder 142 or 142 is in the form of a rounded knob or cuff which protrudes from the inside surface 131 of the garment 140 so that when the garment 140 is operatively worn, each bladder 142 protrudes toward the wearer of the garment 140.

With reference to FIG. 12, each bladder 142 or 142 is connected to container means 156 for holding a quantity of compressed air or gas under pressure and releasing a portion of the compressed contents into the bladders 142,142 through hoses 146 and suitable valving 148. There is associated with the valving 148 actuating means, indicated 150, for selectively opening and closing the valving 148 as desired for controlling the flow of compressed air into the bladders 142,142. Additional valving, indicated 152, is operatively connected with each bladder 142 by means of a hose 158 and to the actuating means 150 for relieving the pressure inside each bladder 142 as desired. The actuating means 150 can be in the form of an electromechanical device for opening and closing in sequence the valving 148 and valving 152 to inflate and deflate each bladder 142. When the garment 140 is operatively worn by a wearer and each bladder 142 is alternately inflated and deflated as aforesaid, the bladders 142,142 percuss or tap selected regions of the wearer's torso in a pulsating manner.

The bladders 142,142 are located along the inside surface 131 of the garment 140 so that the percussion effect of the pulsating bladders 142,142 aids, for example, the explusion of sputum which may accumulate in the lungs of the wearer and is believed to aid in the wearer's recovery of jet lag. The advantage provided by the garment 140 relates to the fact that rather than having medical personnel attending to an individual for purposes of percussing appropriate body portions, selected body portions can be percussed by the percussion bladders 142,142 at much less cost.

It will be understood that numerous modifications and substitutions can be made to the aforedescribed embodiments without departing from the spirit of the invention. For example, although the envelope 80 attached to the collar member 24 of the garment 20 of FIGS. 1–8 has been shown and described above as being in the form of a single envelope 80, the envelope 80 can be comprised of any of a number of envelopes. For example, there is shown in FIG. 13 a garment 120 having a collar member 124 and envelope-defining means 126 including a plurality of envelopes or bladders 130 or 130 spaced around the member 124 and which are inflatable to collectively provide a cushioned protective sleeve about the wearer's head. Furthermore, the vest portion 22 of the garment 20 can be constructed to include a series of flexible conduits 132 (FIG. 1) permitting a cooled or heated medium to be routed therethrough for purposes of cooling or heating the wearer W. Still further and with regard to the precussion garment 140 of FIGS. 9–11, a further embodiment of the garment 140 can have a plurality of percussion bladders disposed in alternative locations over the inside surface of the garment for percussion alternative regions of the wearer's torso. Accordingly, the aforedescribed embodiments are intended for the purpose of illustration and not as limitation.

I claim:

1. A protective garment comprising:

means defining a vest for substantially covering the torso of a wearer, said vest having a front, a back, two opposite sides, a neck portion and a waist portion;

a collar member attached to said vest neck portion and of such size so as to closely encircle and substantially cover the wearer's neck when the garment is operatively worn;

envelope-defining means defining an inflatable envelope connected to said collar member which, when uninflated, is maintained in a relatively compact condition adjacent said collar member and which, when operatively inflated, provides a cushioned protective sleeve which substantially and closely encircles and covers the front, back and sides of the head of the wearer and which substantially braces the wearer's neck in alignment with the torso and means operatively associated with said envelope-defining means for inflating said envelope upon the occurrence of a predetermined event.

2. A garment as defined in claim 1 wherein the portion of said envelope-defining means adapted to cover the eyes of the wearer when said envelope-defining means is operatively inflated is transparent.

3. A garment as defined in claim 1 wherein said envelope-defining means is constructed of a transparent material.

4. A garment as defined in claim 1 wherein said envelope-defining means, when operatively inflated, is bulbous in shape.

5. A garment as defined in claim 1 wherein said envelope-defining means includes a plurality of inflatable envelopes attached to said collar portion and spaced thereabout so that when inflated said plurality of envelopes collectively provide said cushioned protective sleeve.

6. A garment as defined in claim 1 further comprising means connected to said vest-defining means for attaching said garment to a chair and the like.

7. A garment as defined in claim 1 wherein said vest-defining means includes a plurality of bladder compartments operatively connected to said inflating means for inflating said vest-defining means upon the occurrence of a predetermined event.

8. A garment as defined in claim 1 wherein said inflatable envelope is a first inflatable envelope and said envelope-defining means further includes at least one additional inflatable envelope associated with said inflating means and attached to said vest portion which, when uninflated, is maintained in a relatively compact condition adjacent the vest and which, when operatively inflated, provides a cushioned protective apron covering at least the sides and front of the wearer's thighs.

9. A garment as defined in claim 8 wherein there is a second and third additional inflatable envelope each attached to said vest portion and maintained, when uninflated, in a relatively compact condition along a corresponding side of the vest and which, when inflated, cooperates with the other additional envelope to collectively provide the protective apron.

10. A garment as defined in claim 9 wherein each of said second and third inflatable envelopes includes a plurality of distensible compartments operatively connected to said inflating means for inflating said second and third envelopes upon the occurrence of a predetermined event.

11. A garment as defined in claim 9 wherein said second and third inflatable envelopes are adapted to expand generally radially outwardly of said vest-defining means when operatively inflated so that when the wearer is seated, said second and third inflatable envelopes, when inflated, substantially cover the wearer's lap.

12. A garment as defined in claim 1 wherein said means for inflating includes a pressurized gas canister adapted to release gas into said envelope-defining means upon the occurrence of a predetermined event.

13. A garment as defined in claim 1 wherein said garment includes at least one inflatable percussion bladder arranged along the inside surface of said vest-defining means and which, when uninflated is maintained in a relatively flat condition upon the inside surface of the vest-defining means and which, when operatively inflated provides a knob which protrudes generally inwardly of the vest for percussing a selected region of the wearer's body and said garment further comprises means operatively associated with said percussion bladder for abruptly inflating said bladder.

14. A garment as defined in claim 13 wherein said means for abruptly inflating said percussion bladder includes means for rapidly inflating and deflating said percussion bladder for percussing a selected region of the wearer's body in a pulsating fashion.

15. A garment as defined in claim 14 wherein said means for rapidly inflating and deflating said percussion bladder includes a container of pressurized gas, a first valving means operatively connected between said container and said bladder, a second valving means for relieving pressure within said bladder, and an actuator operatively connected between said first and second valving means for opening and closing in sequence said first and second valving means for rapidly inflating and deflating said bladder with pressurized gas of said container.

16. A protective garment as defined in claim 1 wherein said vest includes means defining flexible conduits extending therethrough through which a cooled or heated medium can be routed for purposes of cooling or heating the wearer.

17. A protective garment comprising:

means defining a vest for substantially covering the torso of a wearer, said vest having a front, a back, two opposite sides, a neck portion and a waist portion;

envelope-defining means defining at least one inflatable envelope attached to said vest portion, which when uninflated is maintained in a relatively compact condition adjacent said vest and which, when operatively inflated, extends generally radially outwardly of said vest portion and thereby provides a cushioned protective apron for covering at least the sides and front of the wearer's thighs when the wearer assumes a seating posture; and means operatively associated with said envelope-defining means for inflating said inflatable envelope upon the occurrence of a predetermined event.

18. A protective garment as defined in claim 17 wherein there are one and another envelopes attached to said vest portion and maintained, when uninflated, in a relatively compact condition along a corresponding side of the vest and which, when inflated, cooperates with the other envelope to collectively provide the protective apron.

19. A garment as defined in claim 18 wherein each of said one and another inflatable envelopes includes a plurality of distensible compartments operatively connected to said inflating means for inflating said one and another envelopes upon the occurrence of a predetermined event.

20. A garment as defined in claim 18 wherein said one and another inflatable envelopes are adapted to expand generally radially outwardly of said vest-defining means when operatively inflated so that when the wearer is seated, said one and another enevlopes, when inflated, substantially cover the wearer's lap.

21. A garment as defined in claim 17 further comprising means connected to said vest-defining means for attaching said garment to a chair and the like.

22. A garment as defined in claim 17 wherein said vest-defining means includes a plurality of bladder compartments operatively connected to said inflating means for inflating said vest-defining means upon the occurrence of a predetermined event.

23. A garment as defined in claim 17 wherein said means for inflating includes a pressurized gas canister adapted to release gas into said one and another envelopes upon the occurrence of a predetermined event.

24. A protective garment comprising:

means defining a vest for substantially covering the torso of a wearer, said vest having a front, a back, two opposite sides, a neck portion and a waist portion;

at least one inflatable percussion bladder arranged along the inside surface of said vest-defining means and which, when uninflated, is maintained in a relatively flat condition upon the inside surface of the vest-defining means and which, when operatively inflated, provides a knob which protrudes generally inwardly of the vest for percussing a selected region of the wearer's body; and means operatively associated with said percussion bladder for abruptly inflating and deflating said bladder in a pulsating manner.

* * * * *